US005131319A

United States Patent [19]

Ono et al.

[11] Patent Number: 5,131,319

[45] Date of Patent: Jul. 21, 1992

[54] WOBBLE PLATE TYPE REFRIGERANT COMPRESSOR HAVING A BALL-AND-SOCKET JOINT LUBRICATING MECHANISM

[75] Inventors: Tokihito Ono, Isesaki; Hidetoshi Chiyoda, Honjo, both of Japan

[73] Assignee: Sanden Corporation, Gunma, Japan

[21] Appl. No.: 656,463

[22] Filed: Feb. 19, 1991

[30] Foreign Application Priority Data

Feb. 19, 1990 [JP] Japan ..... 2-36149

[51] Int. Cl.[5] ..... F01B 31/10; F01M 1/00

[52] U.S. Cl. ..... 92/71; 92/153; 184/6.17

[58] Field of Search ..... 92/12.2, 71, 153, 157, 92/70; 417/222 S, 269, 222 R; 184/6.17

[56] References Cited

U.S. PATENT DOCUMENTS

| | | | |
|---|---|---|---|
| 1,714,145 | 5/1929 | Sperry | 92/71 X |
| 1,839,592 | 1/1932 | Reynolds | 184/6.17 |
| 2,190,812 | 2/1940 | Wahlmark | 92/12.2 X |
| 2,821,932 | 2/1958 | Lucien | 417/269 |
| 3,712,759 | 1/1973 | Olson, Jr. | 417/269 |
| 3,857,462 | 12/1974 | Kaufman et al. | 184/11 A |
| 3,958,901 | 5/1976 | Drevet | 184/6.17 X |
| 4,005,948 | 2/1977 | Hiraga et al. . | |
| 4,037,993 | 7/1977 | Roberts | 417/222 S |
| 4,174,191 | 11/1979 | Roberts | 417/269 X |
| 4,236,878 | 12/1980 | Terauchi | 417/269 |
| 4,505,016 | 3/1985 | Roberts | 417/269 X |
| 4,546,692 | 10/1985 | Lotter et al. | 92/12.2 |
| 4,586,876 | 5/1986 | Kato et al. . | |
| 4,729,718 | 3/1988 | Ohta et al. . | |
| 4,973,229 | 11/1990 | Oono et al. | 92/12.2 X |

FOREIGN PATENT DOCUMENTS

| | | | |
|---|---|---|---|
| 1061184 | 7/1959 | Fed. Rep. of Germany | 417/269 |
| 1104109 | 6/1955 | France | 417/269 |
| 1132634 | 11/1956 | France | 417/269 |
| 1184849 | 2/1959 | France | 417/269 |
| 538013 | 6/1956 | Italy | 417/269 |
| 14403 | 2/1978 | Japan | 417/269 |

*Primary Examiner*—Edward K. Look
*Assistant Examiner*—John Ryznic
*Attorney, Agent, or Firm*—Banner, Birch, McKie & Beckett

[57] ABSTRACT

A wobble plate type refrigerant compressor having a lubricating mechanism provided at a ball-and-socket joint between a wobble plate and a piston rod is disclosed. A wobble plate type refrigerant compressor includes a compressor housing having a cylinder block. A plurality of cylinders are formed around the periphery of the cylinder block and a piston is slidably fitted within each of the cylinders and is reciprocated by a drive mechanism. A crankcase is formed between the cylinder block and a front end plate of the compressor housing. The drive mechanism includes a drive shaft, a rotor fixed to the drive shaft and a wobble plate disposed on an inclined surface of the rotor. The piston rod connects the wobble plate to the piston. A ball at one end of the rod is received in a socket formed at the wobble plate to form a ball-and-socket joint. A hole is formed at the wobble plate to link one end surface of the wobble plate to the friction surface of the ball-and-socket joint. A pair of grooves extending from one opening of the hole and terminating near the outer periphery of the wobble plate are formed at one end surface of the wobble plate. Thereby, the lubricating oil adhering to one end surface of the wobble plate is effectively led to the friction surface of the ball-and-socket joint.

5 Claims, 3 Drawing Sheets

WOBBLE PLATE TYPE REFRIGERANT COMPRESSOR HAVING A BALL-AND-SOCKET JOINT LUBRICATING MECHANISM

BACKGROUND OF THE INVENTION

1. Field of the Invention

The present invention relates to a wobble plate type refrigerant compressor, and more particularly, to a lubricating mechanism provided at a ball-and-socket joint between a wobble plate and a piston rod in the wobble plate type refrigerant compressor.

2. Description of the Prior Art

A wobble plate type refrigerant compressor having a lubricating mechanism provided at a ball-and-socket joint between a wobble plate and a piston rod is disclosed in Japanese Utility Model Application Publication No. 52-169106.

Referring to FIG. 1, the wobble plate type refrigerant compressor includes cam rotor 300 which is fixed on a drive shaft (not shown) by any suitable means so that cam rotor 300 is rotated along with the drive shaft. Cam rotor 300 includes annular projection 300*a* projecting form inclined surface 300*b* thereof. Wobble plate 310, made of an aluminum alloy, is mounted on annular projection 300*a* of cam rotor 300 through bearing element 320 and is disposed on inclined surface 300*b* of cam rotor 300 through thrust needlebearing 330. Bearing element 320 includes flange portion 320*a* formed at one end thereof so as to prevent the axial movement of wobble plate 310. By means of bearing element 320 and thrust needle bearing 330, wobble plate 310 nutates, but does not rotate, during the rotation of cam rotor 300. A piston (not shown) is connected to wobble plate 310 through piston rod 340 which is made of steel. Ball 341 at one end of rod 340 is firmly received in socket 311 of wobble plate 310 by caulking an edge of socket 311. However, ball 341 slides along an inner spherical surface of socket 311.

Since steel is harder than aluminum alloy, when ball 341 slides along the inner spherical surface of socket 311 during the operation of the compressor, abrasion at the inner spherical surface of socket 311 cannot be neglected. In order to resolve this defect, a small diameter axial hole 312, linking one end surface of wobble plate 310 facing inclined surface 300*b* of cam rotor 300 to the inner spherical surface of socket 311, is formed in wobble plate 310. Thus, small diameter axial hole 312 leads the suspended lubricating oil in a crankcase of the compressor to the inner spherical surface of socket 311.

However, since hole 312 is covered by thrust needle bearing 330, the suspended lubricating oil in the crankcase cannot be effectively led to the friction surface between the outer spherical surface of ball 341 and the inner spherical surface of socket 311. Therefore, the abrasion at the inner spherical surface of socket 311 cannot be sufficiently prevented.

SUMMARY OF THE INVENTION

Accordingly, it is an object of the present invention to provide a wobble plate type refrigerant compressor comprising a lubricating mechanism which can sufficiently supply the suspended lubricating oil in a crankcase to a friction surface of a ball-and-socket joint between a wobble plate and a piston rod to prevent abrasion at an inner spherical surface of the socket.

A wobble plate type refrigerant compressor comprises a cylinder block in which pistons are reciprocated within respective cylinders by a wobble plate member. The wobble plate member is driven by an inclined rotor member which is secured on a drive shaft. The wobble plate member is adjacently disposed and relatively rotatably on an inclining surface of the rotor member. A piston rod connects the wobble plate member to the piston. The piston rod includes a ball formed at one end thereof. The ball is received in a socket formed at a periphery of the wobble plate to form a ball-and-socket joint. A hole links one end surface of the wobble plate facing the inclining surface of the rotor member to a friction surface between an outer spherical surface of the rotor member and an inner spherical surface of the socket. A pair of grooves radially extend from one opening of the hole and terminate near the periphery of the wobble plate; thus, a V-shaped configuration is formed at one end surface of the wobble plate.

DETAILED DESCRIPTION OF THE PREFERRED EMBODIMENT

Figure 2:
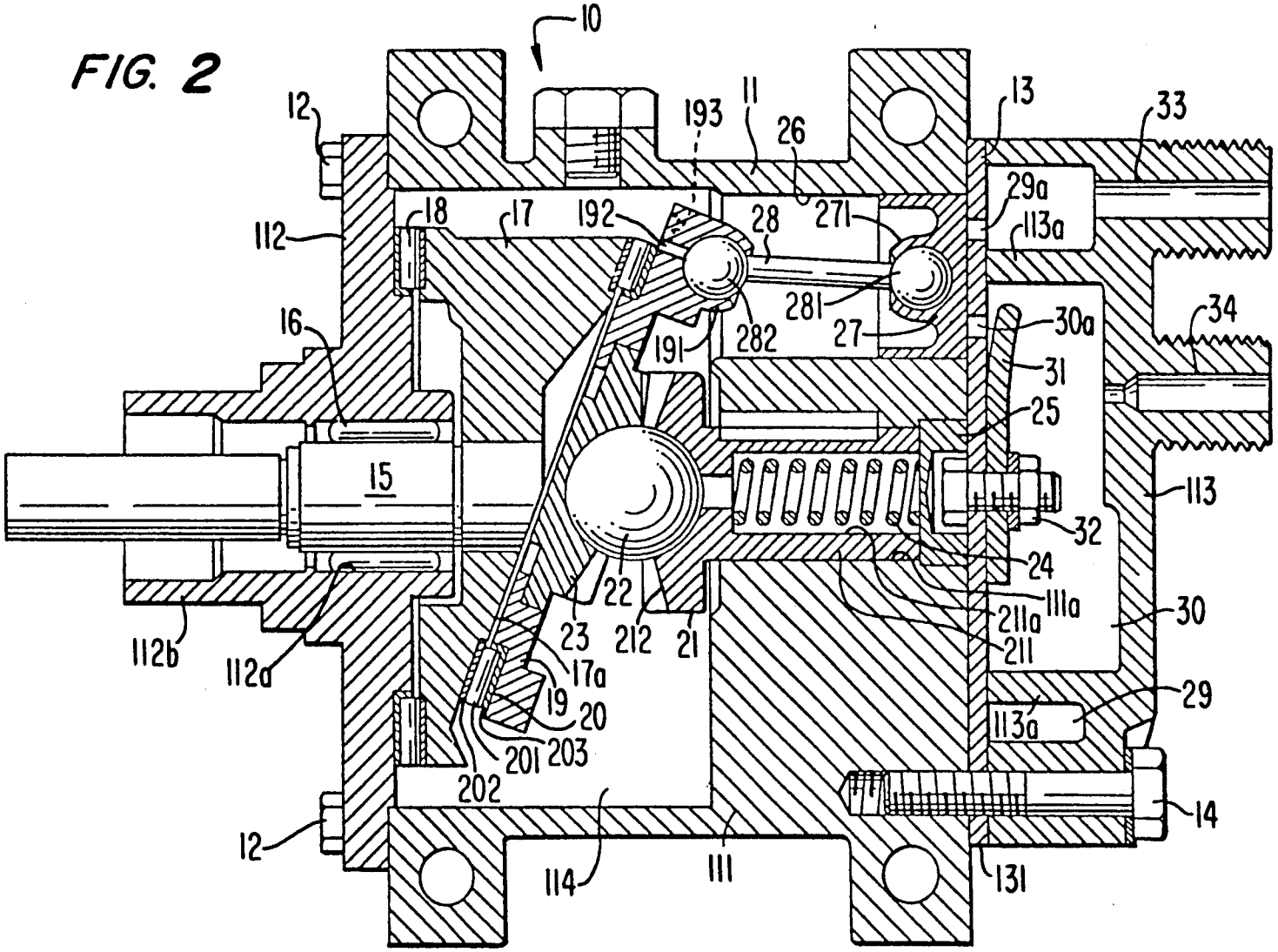
FIG. 2 illustrates a vertical longitudinal sectional view of a wobble plate type refrigerant compressor in accordance with one embodiment of the present invention.

Referring to FIG. 2, a wobble plate type refrigerant compressor 10 comprises cylindrical housing 11. Cylindrical housing 11 includes cylinder block 111, front end plate 112 and cylinder head 113. The interior of housing 11 defines crankcase 114 between cylinder block 111 and front end plate 112 which is mounted on the left end portion of cylinder block 111 by a plurality of bolts 12. Cylinder head 113 together with valve plate assembly 13 are mounted on the right end portion of cylinder block 111 by a plurality of bolts 14. Opening 112*a* is centrally formed in front end plate 112 and drive shaft 15 is rotatably supported by a bearing, such as radial needle bearing 16 disposed in opening 112*a*. Front end plate 112 includes annular sleeve portion 112*b* projecting from the front surface thereof. Annular sleeve projection 112*b* surrounds drive shaft 15 to define a shaft seal cavity in which a shaft seal element (not shown) is disposed.

Drive shaft 15 is attached to cam rotor 17 at its inner end by any suitable means so that cam rotor 17 is rotated along with drive shaft 15. Cam rotor 17 is supported on an inner surface of front end plate 112 by means of a bearing, such as thrust needle bearing 18 disposed at the inner surface of front end plate 112. Wobble plate 19 is disposed on inclined surface 17*a* of cam rotor 17 through thrust needle bearing 20. Thrust needle bearing 20 includes a plurality of peripherally located needle rollers 201 which are disposed between first and second annular races 202 and 203. First annular race 202 is disposed on inclined surface 17*a* of cam rotor 17 and second annular race 203 is disposed on one end surface of wobble plate 19 facing inclined surface 17*a*.

Supporting member 21, including shank portion 211 having axial hole 211*a* formed therein, is axially slidable and non-rotatably supported within cylinder block 111 by the insertion of shank portion 211 into axial hole 111*a* formed in cylinder block 111. The rotation of supporting member 21 is prevented by means of a key and key groove (not shown). Supporting member 21 further includes bevel gear portion 212 at the end of shank portion 211. Bevel gear portion 212 includes a seat for steel ball 22 at the center thereof. Bevel gear portion 212 of supporting member 21 engages with bevel gear 23 mounted on wobble plate 19. Steel ball 22 is also positioned in a seat formed at the central portion of bevel gear 23, thereby allowing wobble plate 19 to be nutatably, but not rotatably, supported on steel ball 22. Coil spring 24 is disposed in axial hole 211*a* of supporting member 21 and the outer end of spring 24 is in contact with screw member 25, thereby urging supporting member 21 toward wobble plate 19.

Cylinder block 111 is provided with a plurality of axial cylinders 26 formed therein, within which pistons 27 are slidably and closely fitted. Each piston 27 is connected to wobble plate 19 through piston rod 28 made of steel. Ball 281 at one end of rod 28 is firmly received in socket 271 of piston 27 by caulking an edge of socket 271, and ball 282 at the other end of rod 28 is firmly received in socket 191 of wobble plate 19 by caulking an edge of socket 191. But, balls 281 and 282 slide along an inner spherical surface of sockets 271 and 191, respectively. It should be understood that, although only one ball-and-socket joint is shown in the drawing, there are a plurality of sockets arranged peripherally around wobble plate 19 to receive the balls of various rods 28, and that each piston 27 is formed with a socket for receiving the other ball of rods 28.

Cylinder head 113 is provided with suction chamber 29 and discharge chamber 30, separated by partition wall 113*a*. Valve plate assembly 13 includes valve plate 131 having suction ports 29*a* connecting suction chamber 29 with cylinders 26 and discharge ports 30*a* connecting discharge chamber 30 with cylinders 26. Valve plate assembly 13 further includes a suction reed valve (not shown), provided at each of suction ports 29*a*, and a discharge reed valve (not shown), provided at each of discharge ports 30*a*. Additionally, a circular gasket (not shown) and an annular gasket (not shown) are provided to seal the mating surfaces of cylinder block 111, valve plate 131 and cylinder head 113. Stopper plate 31 suppresses excessive deformation of the discharge reed valve. Bolt and nut device 32 secures the circular gasket, suction reed valve, discharge reed valve, and stopper plate 31 to valve plate 131.

In operation of the compressor, drive shaft 15 is driven by any suitable driving source, such as an automobile engine. Cam rotor 17 rotates with drive shaft 15, so that wobble plate 19 may nutate about steel ball 22 according to the rotation of inclined surface 17*a* of cam rotor 17. The nutation of wobble plate 19 causes the reciprocation of each respective piston 27. Therefore, the successive strokes of suction, compression and evacuation of the refrigerant gas are repeatedly performed in each cylinder 26. The refrigerant gas circulates through a cooling circuit connected between inlet port 33 and outlet port 34, which are provided on suction chamber 29 and discharge chamber 30, respectively.

Figure 1:
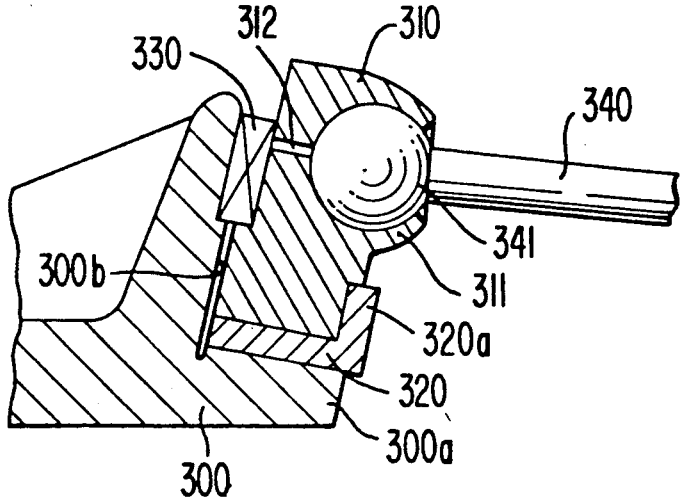
FIG. 1 (PRIOR ART)
FIG. 1 illustrates an enlarged partially sectional view of a prior art lubrication mechanism provided at a ball-and-socket joint between a wobble plate and a piston rod in a wobble plate type refrigerant compressor.
Figure 5:
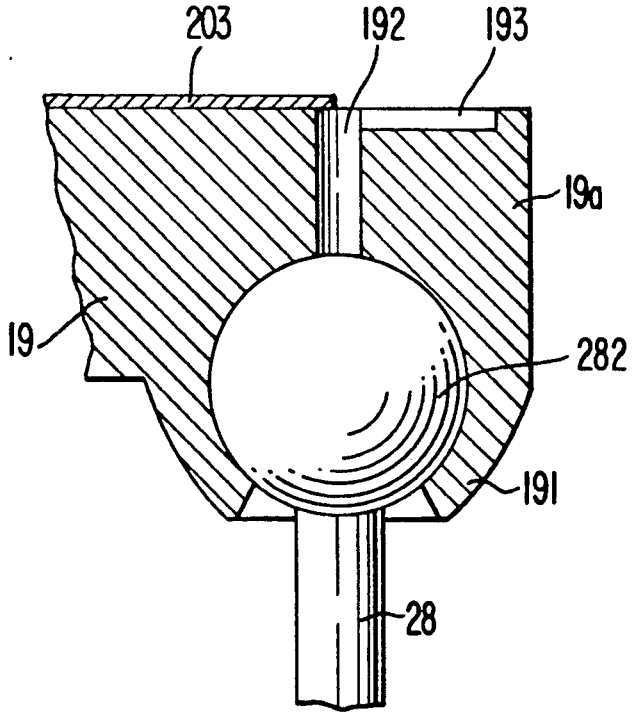
FIG. 5 illustrates a sectional view taken along line 5—5 of FIG. 4.
Figure 3:
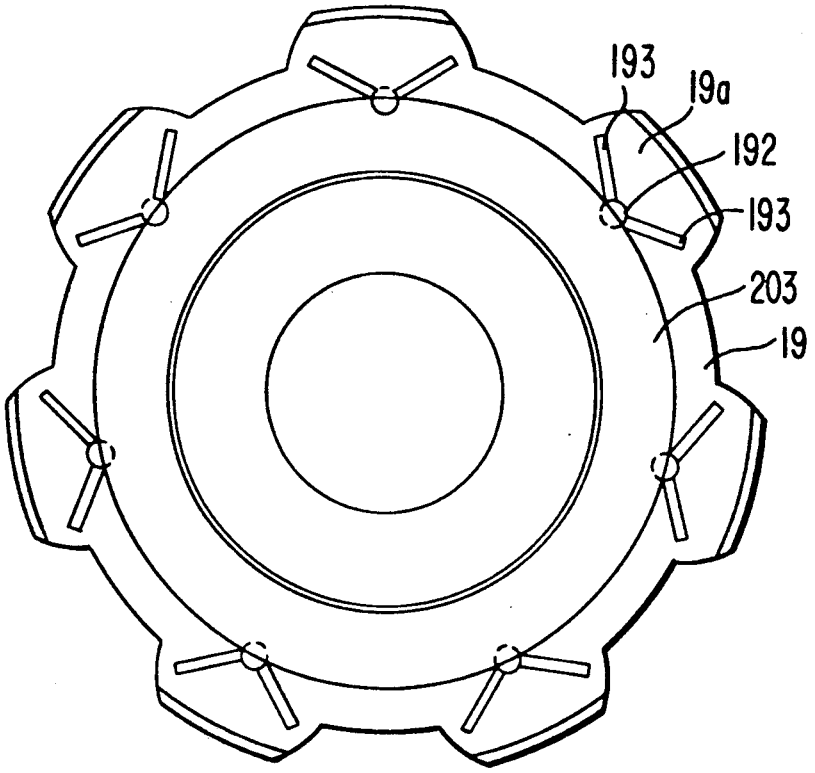
FIG. 3 illustrates a side view of the wobble plate shown in FIG. 2, particularly showing a lubricating mechanism provided at the ball-and-socket joint thereof..
Figure 4:
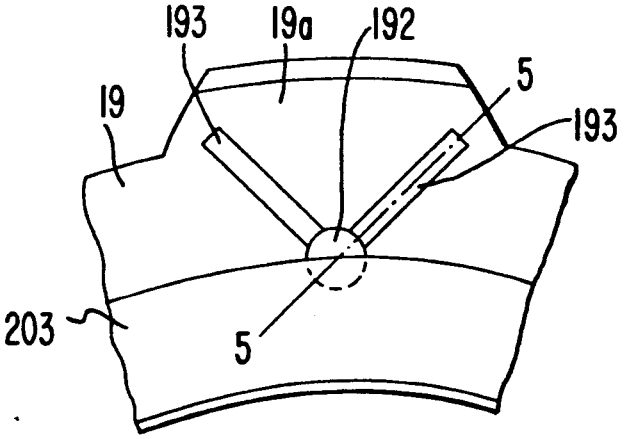
FIG. 4 illustrates an enlarged partially side view of FIG. 3.

Referring to FIGS. 3–5 additionally, socket 191 is formed at each of a plurality of radial projections 19*a* projecting from an outer periphery of wobble plate 19. Small diameter axial hole 192, linking opened surface of wobble plate 19 facing inclined surface 17*a* of cam rotor 17 to a friction surface between an outer spherical surface of each ball 282 and an inner spherical surface of each socket 191, is formed in wobble plate 19. A pair of grooves 193 extend from each hole 192 and terminate near the outer periphery of wobble plate 19, thus forming a V-shaped configuration at one end surface of wobble plate 19. Second annular race 203 radially extends to the center of one opening of hole 192.

In this construction, during operation of the compressor, the suspended lubricating oil in crankcase 114 adheres to one end surface of wobble plate 19. Then, the lubricating oil is effectively led from the crankcase to the friction surface between the outer spherical surface of ball 282 and the inner spherical surface of socket 191 via grooves 193 and hole 192. A sufficient amount of lubricating oil can be supplied to the friction surface between the outer spherical surface of ball 282 and the inner spherical surface of socket 191. Accordingly, the abrasion at the inner spherical surface of socket 191 can be effectively prevented.

Furthermore, the number, length, extending direction and sectional configuration of the grooves 193 may be freely designed in response to demand.

This invention has been described in detail in connection with a preferred embodiment. This is for illustrative purposes only and the invention should not limited thereto. It will be easily understood by those skilled in the art that variations and modifications can be easily made within the scope of this invention as defined by the appended claims:

We claim:

1. A refrigerant compressor in which pistons are reciprocated within respective cylinders by a wobble plate member driven by an inclined rotor member secured on a drive shaft, said wobble plate member being adjacently disposed and relatively rotatable on an inclining surface of said rotor member, at least one piston rod connecting said wobble plate member to one of said pistons, said piston rod including a ball formed at one end thereof, said ball being received in a socket formed at periphery of said wobble plate to form a ball-and-socket joint, a hole linking one end surface of said wobble plate facing the inclining surface of said rotor member to a friction surface between an outer spherical surface of said ball and an inner spherical surface of said socket, the improvement comprising:

at least one groove means which radially extends outwards from said hole being formed at said one end surface of said wobble plate such that lubricating fluid in a compressor crankcase is guided along said at least one groove means and introduced through said hole, thereby improving lubrication of the friction surface of said ball-and-socket joint.

2. The refrigerant compressor of claim 1 wherein a pair of grooves extend from said hole and terminate near the periphery of said wobble plate, thereby forming a V-shaped configuration.

3. A refrigerant compressor comprising:

a cylinder block;

said cylinder block comprising a plurality of cylinders;

a plurality of pistons;

each of said pistons being disposed in one of said cylinders;

a drive shaft;

an inclined rotor member secured on said drive shaft;

a wobble plate member adjacent to and driven by said inclined rotor member;

a piston rod connecting said wobble plate member to said piston;

said piston rod including a ball formed on one end thereof;

a ball-and-socket joint formed by said ball being received in a socket provided on the periphery of said wobble plate;

a hole extending through said wobble plate and linking an end surface of said wobble plate that faces the inclining surface of said rotor member to said ball-and-socket joint; and at least one groove means extending radially outwards from said hole, whereby suspended oil in a crankcase of said compressor is guided therealong to said hole and thus to the mating surface of said ball and said socket.

4. The refrigerant compressor of claim 3 wherein a pair of grooves extend from said hole and terminate near the periphery of said wobble plate.

5. The refrigerant compressor of claim 4 wherein said pair of grooves form a V-shaped configuration.

* * * * *